US008457529B2

(12) United States Patent
Moore

(10) Patent No.: US 8,457,529 B2
(45) Date of Patent: Jun. 4, 2013

(54) PREEMPTIVE PHOTORECEPTOR VELOCITY MODULATION TO MINIMIZE TRANSIENT BANDING

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 302 days.

(21) Appl. No.: 12/940,118

(22) Filed: Nov. 5, 2010

(65) Prior Publication Data

US 2012/0114380 A1 May 10, 2012

(51) Int. Cl.
*G03G 15/00* (2006.01)
*G03G 15/16* (2006.01)
*G03G 15/01* (2006.01)

(52) U.S. Cl.
USPC ..... 399/167; 399/66; 399/302

(58) Field of Classification Search
USPC ..... 399/9, 66, 167, 302, 308
See application file for complete search history.

(56) References Cited

U.S. PATENT DOCUMENTS 5,508,789 A 4/1996 Castelli et al.
5,790,930 A * 8/1998 Fuchiwaki ..... 399/302
6,026,269 A * 2/2000 Setoriyama ..... 399/302
6,697,596 B2 * 2/2004 Bessho et al. ..... 399/302
7,068,952 B2 * 6/2006 Tamaoki ..... 399/302
7,734,235 B2 * 6/2010 Takehara et al. ..... 399/302
7,761,020 B2 * 7/2010 Toizumi et al. ..... 399/66
7,796,934 B2 * 9/2010 Teshigawara ..... 399/302 X

FOREIGN PATENT DOCUMENTS

JP 2006259208 9/2006

OTHER PUBLICATIONS

German Search Report dated Jun. 14, 2012.

* cited by examiner

*Primary Examiner* — Sandra Brase
(74) *Attorney, Agent, or Firm* — Fay Sharpe LLP

(57) ABSTRACT

Described herein is an exemplary method wherein the photoreceptor surface velocity is nominally set at a speed fractionally different than the intermediate belt (ITB) nominal surface speed. The photoreceptor speed can be preemptively altered through a velocity ramp profile whenever an event is scheduled to occur that will result in ITB transient vibration. As a result, the photoreceptor speed is not allowed to cross over or equal the belt speed at any instant during the transient event. This allows the photoreceptor to remain dynamically decoupled from the ITB, since the apparent disturbance torque imposed by the belt remains constant and does not reverse sign.

20 Claims, 4 Drawing Sheets

PREEMPTIVE PHOTORECEPTOR VELOCITY MODULATION TO MINIMIZE TRANSIENT BANDING

BACKGROUND

By way of background, in many image formation systems, one or more image forming members are engaged with an intermediate image carrying member. A substrate is brought into operative contact with the intermediate member in order to receive the image. Non-uniformity in the image formation is created when a disturbance in the velocity profile of the image forming member is encountered. This disturbance is generally caused by the lead and trail edges of the substrate entering/leaving operative contact with the intermediate member More particularly, in tandem color xerographic printers, color separations are built up on an intermediate belt (ITB) at four or more first transfer nips and then transferred onto a media sheet at the second transfer nip. In order to achieve high transfer efficiency, the sheet is brought into intimate contact with the ITB as it passes through a second transfer nip. This nip is formed by a backing bias transfer roll or belt pressing the sheet against the belt, which is supported by a back-up roll. An electric field within the nip is used to move toner from the belt to the media. As the media lead edge enters this nip, a torque disturbance is imposed on the ITB drive system as the sheet pries the nip open. As the sheet trail edge exits this nip, another torque disturbance occurs. These torque disturbances then excite rotational resonance of the ITB drive system, which leads to transient velocity variation of the belt surface. The photoreceptor surface velocity is typically set to match or slightly deviate from the belt nominal speed. When the belt is vibrating, the relative velocity between the intermediate belt and one or more photoreceptors can switch signs, which induces a rotational vibration of the photoreceptors. This vibration causes exposure intensity variations at the imaging location for the photoreceptor, which can result in visible banding on prints.

Accordingly, a method and system for avoiding banding artifacts caused by media handling disturbances at the second transfer is needed.

BRIEF DESCRIPTION

The exemplary embodiment relates to a method wherein the photoreceptor surface velocity is nominally set at a speed fractionally different than the intermediate belt (ITB) nominal surface speed. The photoreceptor speed can be preemptively altered through a velocity ramp profile whenever an event is scheduled to occur that will result in ITB transient vibration. As a result, the photoreceptor speed is not allowed to cross over or equal the belt speed at any instant during the transient event. This feature allows the photoreceptor to remain dynamically decoupled from the ITB, since the apparent disturbance torque imposed by the belt remains constant and does not reverse sign.

Thus, in the case when the photoreceptor speed is nominally set higher than the ITB speed, the photoreceptor speed may be increased slightly when the substrate enters and exits the second transfer nip, so that the photoreceptor is never in a torque assist mode, thereby minimizing velocity variations during exposure that create halftone non-uniformity.

In one embodiment, a printing system comprising an image-carrying member and at least one photoreceptor is provided. The image-carrying member is nominally set to a first speed. The photoreceptor is nominally set to a second speed fractionally different from the first speed. In response to a predictable disturbance in the image-carrying member speed, the photoreceptor speed is adjusted so that its speed never equals the image-carrying member speed.

In another embodiment, a printing method for a printing system comprising an image-carrying member and at least one photoreceptor is provided. The method includes setting the image-carrying member nominally to a first speed, setting the photoreceptor nominally to a second speed fractionally different from the first speed, and in response to a predictable disturbance in the image-carrying member speed, adjusting the photoreceptor speed so that its speed never equals the image-carrying member speed.

In yet another embodiment, a computer program product comprising a computer-usable data carrier storing instructions that, when executed by a computer, cause the computer to perform a printing method is provided. The printing method includes setting an image-carrying member of printing system nominally to a first speed, setting a photoreceptor of the printing system nominally to a second speed fractionally different from the first speed, and in response to a predictable disturbance in the image-carrying member speed, adjusting the photoreceptor speed so that its speed never equals the image-carrying member speed.

BRIEF DESCRIPTION OF THE DRAWINGS

The exemplary embodiments exist in the construction, arrangement, and combination of the various parts of the device, and aspects of the method, whereby the objects contemplated are attained as hereinafter more fully set forth, specifically pointed out in the claims, and illustrated in the accompanying drawings in which:

DETAILED DESCRIPTION

Figure 1:
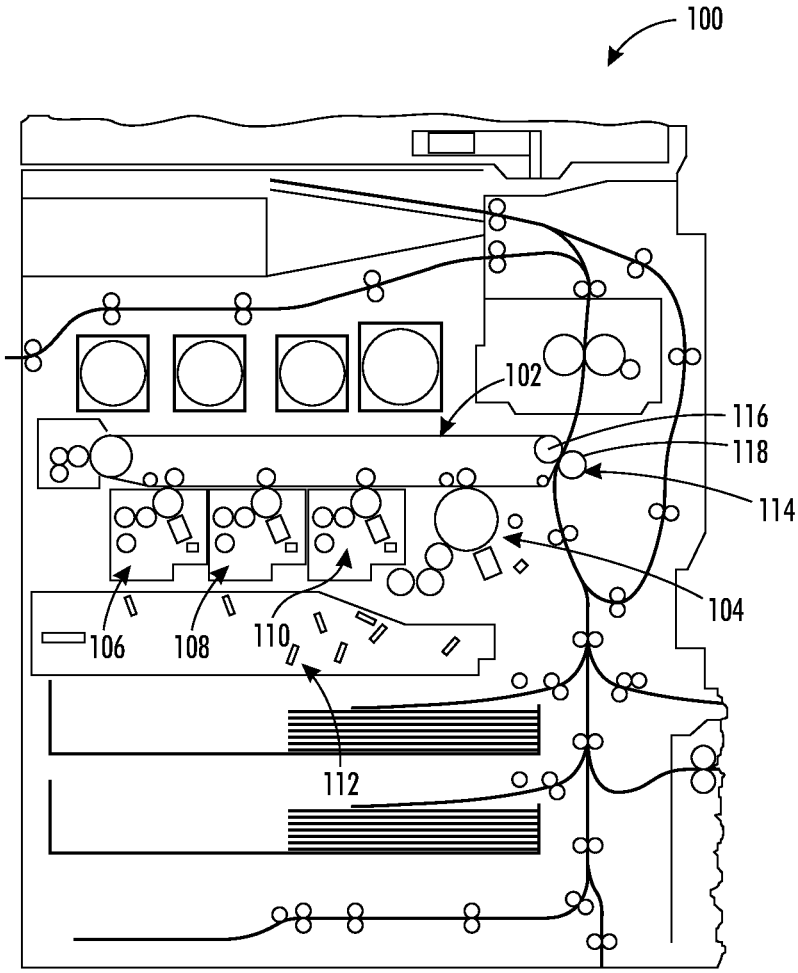
FIG. 1 is a diagram of a printing system suitable for implementing the exemplary embodiments.

In the following description, reference is made to the drawings. In the drawings, like reference numerals have been used throughout to designate identical elements. Although embodiments will be described with reference to the embodiment shown in the drawings, it should be understood that embodiments may be employed in many alternate forms. In addition, any suitable size, shape or type of elements or materials could be used without departing from the spirit of the exemplary embodiments.

In a conventional tandem color printing process, four marking modules may be used. Photoconductive drum marking modules are typically employed in tandem color printing due to the compactness of the drums. A tandem system can alternatively use four photoconductive imaging belts instead of the drums. Each imaging drum or belt subsystem charges the photoconductive surface thereof, forms a latent image on the thereon, develops it as a toned image and then transfers the toned image to an intermediate belt. In this way, yellow, magenta, cyan, and black single-color toner images are separately formed and transferred onto the intermediate surface. The intermediate surface thus serves as an image collection member in that, when superimposed, these four toned images can then be transferred to print media and fused, and is capable of resulting in a wide variety of colors.

FIG. 1 shows an example of an exemplary multifunction marking device 100 that is capable of placing a single color separation onto an image-carrying member such as an intermediate belt (ITB) 102. The ITB 102 is shown oriented horizontally in FIG. 1, although vertical layouts are equally possible.

Xerographic marking is typically performed in cycles by exposing an image of an original document onto a substantially uniformly charged photoreceptor (or P/R). In this example, four photoreceptors are shown, namely, a black (K) photoreceptor 104, a cyan (C) photoreceptor 106, a magenta (M) photoreceptor 108, and a yellow (Y) photoreceptor 110. Each photoreceptor has a photoconductive layer. A charging device initially applies a uniform electric charge onto the photoconductive layer either through contact or non-contact means. Exposing the charged photoreceptor with the image with a raster output scanner (ROS) or imaging array 112 discharges areas of the photoconductive layer corresponding to non-image areas of the original document while maintaining the charge in the image areas. In discharge area development, the reverse is true where the image areas are the discharged areas and the non-image areas are the charged areas. Thus in either case, a latent electrostatic image of the original document is created on the photoconductive layers of the photoreceptors.

The second transfer nip 114 generally consists of a nip formed by the ITB back-up roll 116 and the second bias transfer roll (second BTR) 118. The second BTR 118 is typically a deformable foam or rubber roller, which is spring loaded against the back-up roll 116. The nip preload can be considerable. For example, it could be about 40N without paper present. Therefore, when a thick sheet enters the second transfer nip 114, work must be exerted to deflect the BTR 118 to create a gap. This event essentially behaves as a step torque disturbance acting on the ITB drive train, and it can excite a mode of resonance. The intermediate belt 102 does experience transient oscillations about its average velocity as thick sheets enter and exit its second transfer nip 114. Transient banding defects may occur at distinct points on sheets that are displaced from the leading edge (LE) or trailing edge (TE) event at the second transfer nip 114. For a black image defect, this displacement correlates roughly to the distance from the exposure location of the K photoreceptor 104 to the second transfer 114. Thus, the belt oscillations that occur as, say, the LE arrives at the second transfer 114 are being transmitted to the K photoreceptor 104. The oscillations of the drum may cause ROS periodic exposure variation, which results in banding.

Figure 2:
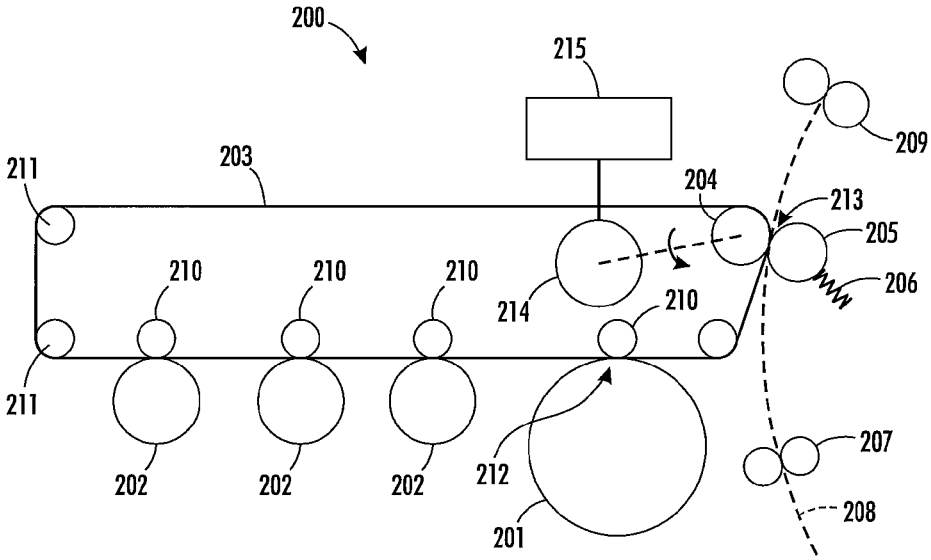
FIG. 2 is a schematic diagram a printing system suitable for implementing the exemplary embodiments.

FIG. 2 illustrates a schematic diagram of a printing system 200. The printing system 200 generally includes, for example, a black (K) photoreceptor (P/R) drum (or belt) 201, one or more color P/R drums (or belts) 202 such as cyan (C), magenta (M), and yellow (Y), an image-carrying member such as an intermediate belt (or drum) 203, a back-up roller 204, a first bias transfer roller (or belt) 205, a compression spring 206, a registration nip 207, a paper path 208, a fusing nip 209, one or more additional bias transfer rollers 210 corresponding to each of the color P/R drums 202, a belt guide roller 211, a first transfer nip 212, a second transfer nip 213, a drive motor 214, and a system controller 215.

As shown in FIG. 2, the second transfer nip 213 generally consists of the back-up roller 204 and the first bias transfer roller 205. The bias transfer roller 205 is typically a deformable foam or rubber roller, which is spring loaded against the back-up roller 204 with tension being provided by the compression spring 206. It should be noted that the compression spring 206 can also be a torsion spring, extension spring or a fixed stop (no spring).

When a thick sheet enters the second transfer nip 213, work must be exerted to deflect the first bias transfer roller 205 to create a gap. This event essentially behaves as a step torque disturbance acting on the drive train of the intermediate belt 203, and it can excite a mode of resonance. The intermediate belt 203 does experience transient oscillations about its average velocity as thick sheets enter and exit the second transfer nip 213. Transient banding defects may occur at distinct points on sheets that are displaced from the leading edge (LE) or trailing edge (TE) event at the second transfer nip 213. For a black image defect, this displacement correlates roughly to the distance from the exposure location of the K photoreceptor drum 201 to the second transfer nip 213. Thus, the belt oscillations that occur as, say, the LE arrives at the second transfer nip 213 are being transmitted to the K photoreceptor drum 201. The oscillations of the drum 201 may cause ROS periodic exposure variation, which results in banding.

Figure 3:
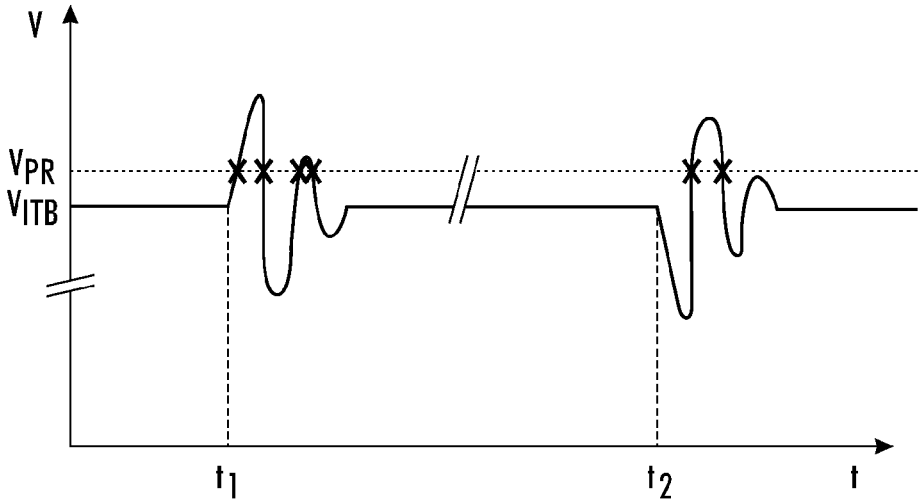
FIG. 3 is a graph of the velocity profiles versus time of the intermediate belt and the photoreceptor.

FIG. 3 shows a graph with the velocity (V) profiles versus time (t) of the intermediate belt 203 and the photoreceptor (P/R) 201. In this example, the black P/R 201 will be referenced. It is to be understood that the color P/Rs 202 can also be controlled in the described manner. In this example, the nominal drum surface speed ($V_{P/R}$) is set 0.3-0.5% faster than the ITB speed ($V_{ITB}$). This is typical of tandem color machines. This is known to facilitate first transfer performance and also dynamically decouples the belt and photoreceptor drive systems. From the drum drive's perspective, the first transfer nip 212 represents a constant drag torque due to the slip rate. However, also shown is the effect of two transfer events: LE arrival at the second transfer nip ($t_1$) and TE departure from the second transfer nip ($t_2$). Each acts like a step disturbance torque on the belt drive system and each excites a belt module resonance. As measured, these transient disturbances can have amplitudes in the range of 1% of nominal. As a result, the belt speed $V_{ITB}$ crosses over the drum speed at the indicated points marked with an X. When this happens, the P/R drum drive system instantaneously sees an assist torque rather than a drag torque. This induces a step torque disturbance response in the drum drive system (not shown). This drum oscillation causes periodic exposure variation at the point of imaging which generates banding defects on the latent image and subsequently on the print.

Figure 4:
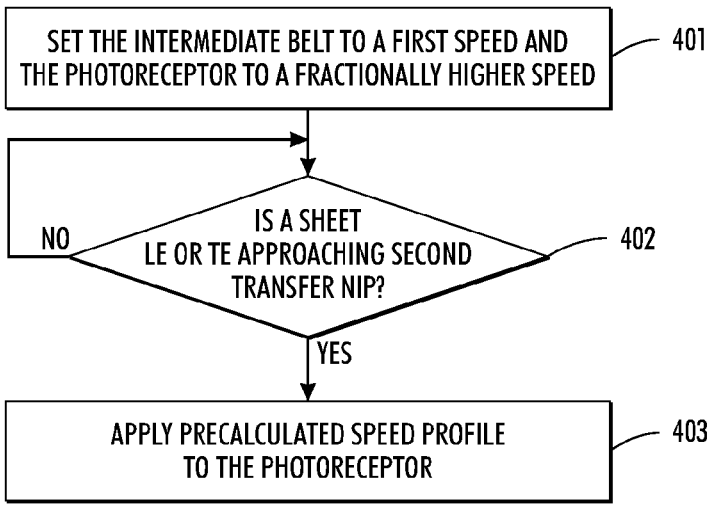
FIG. 4 is a flow chart illustrating an improved printing method in accordance with aspects of the exemplary embodiments.

FIG. 4 shows a method that may be implemented via the controller 215, for example, to solve this problem with the printing system 200 of FIG. 2. Initially, the belt 203 is set to a first speed and the photoreceptor velocity is set to a fractionally higher speed (401). The printing system maintains these speeds during times when no disturbance, such as a sheet LE arrival at the second transfer nip, is expected (402). In response to a predictable disturbance in the belt speed, the photoreceptor speed is adjusted so that its speed never equals the belt speed (403). This higher speed may be maintained for a predetermined period of time, and then the drum may be ramped back to its nominal process speed. The net effect is that the drum speed stays higher than the belt speed at all times, so the photoreceptor drum 201 stays dynamically decoupled from the belt 203 and does not oscillate. A similar ramp event is scheduled when the sheet TE exits the second transfer nip 213.

Figure 5:
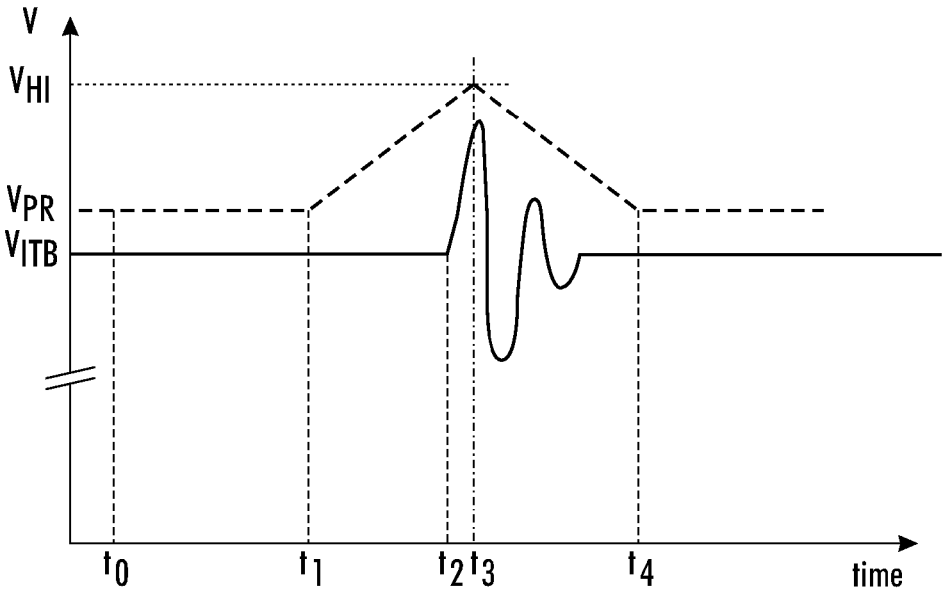
FIG. 5 is a graph of the velocity profiles versus time of the intermediate belt and the photoreceptor according to aspects of the exemplary embodiments.

FIG. 5 shows a graph with the velocity (V) profiles versus time (t) of the intermediate belt (ITB) 203 and the photoreceptor (P/R) 201, which further illustrates aspects of the exemplary method described above and shown in FIG. 4. With reference to FIG. 5, the leading edge of the sheet exits the registration nip 207 at $t_0$. The photoreceptor 201 begins to accelerate at $t_1$. The leading edge of the sheet enters the second transfer nip 213 at $t_2$. At $t_3$, the P/R 201 reaches its peak velocity ($V_{HI}$). After a predetermined time period, the photoreceptor 201 then begins to decelerate. At $t_4$ the photoreceptor 203 returns to its nominal speed.

The rate of acceleration (A) of the photoreceptor may be determined by the following equation:

$$A=(V_{HI}-V_{P/R})/(t_3-t_1) \quad (1)$$

The system controller 215 has timing information encoded for times $t_0$, $t_2$ and $t_3$ and for velocities $V_{HI}$, $V_{P/R}$ and acceleration A. The controller 215 then calculates time $t_1$ from the timing information.

The rate of deceleration (D) of the photoreceptor 201 may be determined by the following equation:

$$D=(V_{HI}-V_{P/R})/(t_4-t_3) \quad (2)$$

The system controller 215 has timing information encoded for times $t_0$, $t_2$ and $t_3$ and for velocities $V_{HI}$, $V_{P/R}$ and acceleration A. The controller 215 then calculates time $t_4$ from the timing information.

Optionally, $V_{P/R}$ and $V_{HI}$ can be picked so that is always lower (not higher) than $V_{ITB}$.

Although intentional variation of the photoreceptor 201 may seem counter to the goal of maintaining uniform latent image exposure, in this method a planned velocity excursion as shown in FIG. 5 is superior to allowing the photoreceptor 201 to oscillate. One reason is the spatial periodicity of the exposure variation will be less apparent to the viewer than typical banding signature: there is only one cycle per event and it has a relatively large spatial period. For example, if the entire event lasts 0.10 sec and the nominal speed is 250 mm/s, the event may be spread out over a 25 mm portion of the page. The eye is generally more sensitive to the spatial periodicity in the 1 mm range. Further, since this is a planned event, it is possible to coordinate the photoreceptor velocity change with a change in imager (ROS or LED) exposure level.

For a printing system operating at 250 mm/s drum speed, a velocity ramp event lasting at total of 0.10 sec with amplitude peak of 0.5% of nominal speed may cause a local process direction magnification error of 0.063 mm, which is a minor effect. Color to color registration is not affected provided that all photoreceptors undergo the same velocity ramp simultaneously and the drums are synchronously pitched to each other, i.e., the local magnification errors will land on top of each other. Further, the parameters of the velocity ramp (amplitude and duration) could be made adjustable by the system and perhaps disabled if, for instance, thin media is being printed.

A person of skill in the art would readily recognize that steps of various above-described methods can be performed by programmed computers. Herein, some embodiments are also intended to cover program storage devices, for example, digital data storage media, which are machine or computer readable and encode machine-executable or computer-executable programs of instructions, wherein said instructions perform some or all of the steps of said above-described methods. The program storage devices may be, for example, digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the figures, including any functional blocks labeled as "controllers," may be provided through the use of dedicated hardware as well as hardware capable of executing software in association with appropriate software including processors. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A printing system comprising an intermediate image-carrying member in operative contact with at least one image forming member, wherein the intermediate member is nominally set to a first speed, the image forming member is nominally set to a second speed fractionally different from the first speed, and in response to a predictable disturbance in the intermediate member speed, the image forming member speed is adjusted so that its speed never equals the intermediate member speed.

2. The printing system of claim 1, wherein the image forming member comprises a photoreceptor belt.

3. The printing system of claim 1, wherein the image forming member comprises a photoreceptor drum.

4. The printing system of claim 1, wherein the intermediate member comprises a belt.

5. The printing system of claim 1, wherein the intermediate member comprises a drum.

6. The printing system of claim 1, wherein the image forming member accelerates at a rate according to the following equation:

$A=(V_{HI}-V_{P/R})/(t_3-t_1)$, where A is the acceleration rate of the image forming member, $V_{HI}$ is an expected peak velocity of the image forming member, $V_{P/R}$ is a velocity of the image forming member, $t_3$ is a time at which the image forming member reaches its peak velocity, $t_1$ is a time at which the image forming member begins to accelerate.

7. The printing system of claim 1, wherein the image forming member decelerates at a rate according to the following equation:

$D=(V_{HI}-V_{P/R})/(t_4-t_3)$, where D is the deceleration rate of the image forming member, $V_{HI}$ is an expected peak velocity of the image forming member, $V_{P/R}$ is a velocity of the image forming member, $t_4$ is a time at which the image forming member returns to its nominal speed, $t_3$ is a time at which the image forming member reaches its peak velocity.

8. A printing method for a printing system comprising an intermediate image-carrying member and at least one image forming member, wherein the method comprises setting the image-carrying member nominally to a first speed, setting the image forming member nominally to a second speed fractionally different from the first speed, and in response to a predictable disturbance in the image-carrying member speed, adjusting the image forming member speed so that its speed never equals the image-carrying member speed.

9. The printing method of claim 8, wherein the image forming member comprises a photoreceptor belt.

10. The printing method of claim 8, wherein the image forming member comprises a photoreceptor drum.

11. The printing method of claim 8, wherein the intermediate member comprises a belt.

12. The printing method of claim 8, wherein the intermediate member comprises a drum.

13. The printing method of claim 8, wherein the image forming member accelerates at a rate according to the following equation:

$A=(V_{HI}-V_{P/R})/(t_3-t_1)$, where A is the acceleration rate of the image forming member, $V_{HI}$ is an expected peak velocity of the image forming member, $V_{P/R}$ is a velocity of the image forming member, $t_3$ is a time at which the image forming member reaches its peak velocity, $t_1$ is a time at which the image forming member begins to accelerate.

14. The printing method of claim 8, wherein the image forming member decelerates at a rate according to the following equation:

$D=(V_{HI}-V_{P/R})/(t_4-t_3)$, where D is the deceleration rate of the image forming member, $V_{HI}$ is an expected peak velocity of the image forming member, $V_{P/R}$ is a velocity of the image forming member, $t_4$ is a time at which the image forming member returns to its nominal speed, $t_3$ is a time at which the image forming member reaches its peak velocity.

15. A computer program product comprising:

a computer-usable data carrier storing instructions that, when executed by a computer, cause the computer to perform a method comprising: setting an image-carrying member of a printing system nominally to a first speed, setting a image forming member of the printing system nominally to a second speed fractionally different from the first speed, and in response to a predictable disturbance in the belt speed, adjusting the image forming member speed so that its speed never equals the belt speed.

16. The product of claim 15, wherein the image forming member accelerates at a rate according to the following equation:

$A=(V_{HI}-V_{P/R})/(t_3-t_1)$, where A is the acceleration rate of the image forming member, $V_{HI}$ is an expected peak velocity of the image forming member, $V_{P/R}$ is a velocity of the image forming member, $t_3$ is a time at which the image forming member reaches its peak velocity, $t_1$ is a time at which the image forming member begins to accelerate.

17. The product of claim 15, wherein the image forming member decelerates at a rate according to the following equation:

$D=(V_{HI}-V_{P/R})/(t_4-t_3)$, where D is the deceleration rate of the image forming member, $V_{HI}$ is an expected peak velocity of the image forming member, $V_{P/R}$ is a velocity of the image forming member, $t_4$ is a time at which the image forming member returns to its nominal speed, $t_3$ is a time at which the image forming member reaches its peak velocity.

18. The product of claim 15, wherein the image forming member comprises a photoreceptor belt or a photoreceptor drum.

19. The product of claim 15, wherein the intermediate member comprises a belt.

20. The product of claim 15, wherein the intermediate member comprises a drum.

* * * * *